US005132491A

United States Patent [19]

Mulrooney et al.

[11] Patent Number: 5,132,491

[45] Date of Patent: Jul. 21, 1992

[54] SHIELDED JACKETED COAXIAL CABLE

[75] Inventors: Christine Mulrooney, Elkton, Md.; Craig R. Theorin, Landenberg, Pa.

[73] Assignee: W. L. Gore & Associates, Inc., Newark, Del.

[21] Appl. No.: 670,084

[22] Filed: Mar. 15, 1991

[51] Int. Cl.[5] ..... H01B 7/34

[52] U.S. Cl. ..... 174/36; 174/105 SC; 174/106 R; 174/106 SC; 174/115

[58] Field of Search ..... 174/36, 105 R, 105 SC, 174/106 R, 106 SC, 107, 115

[56] References Cited

U.S. PATENT DOCUMENTS

| | | | |
|---|---|---|---|
| 3,484,532 | 12/1969 | Anderson | 174/36 |
| 4,477,693 | 10/1984 | Krabec et al. | 174/36 |
| 4,510,346 | 4/1985 | Bursh, Jr. et al. | 174/36 |
| 4,588,852 | 5/1986 | Fetterolf et al. | 174/36 |
| 4,691,081 | 9/1987 | Gupta et al. | 174/105 R |
| 4,701,575 | 10/1987 | Gupta et al. | 174/107 |
| 5,037,999 | 8/1991 | Van Deusen | 174/36 |

*Primary Examiner*—Morris H. Nimmo
*Attorney, Agent, or Firm*—Gary A. Samuels

[57] ABSTRACT

A jacketed coaxial cable including two or more metal shielding layers, including semiconductive polymer coated tape layers surrounding the drain wires, insulation, and center conductor thereof, the jacket thereof being semiconductive or alternatively non-conductive.

15 Claims, 4 Drawing Sheets

SHIELDED JACKETED COAXIAL CABLE

FIELD OF THE INVENTION

The invention pertains to the field of high frequency coaxial signal cables having conductive shielding layers to prevent leakage of electromagnetic energy either into or out of the cable.

BACKGROUND OF THE INVENTION

It is known in the field of high frequency signal transmission that signal lines need to be electrically isolated from adjacent signal lines and ambient electromagnetic energy in order to prevent degradation to the transmitted signal. This is typically accomplished by applying one or more layers of shielding, such as braided metal wire or tape, or one or more layers of metal coated polymer tape. Each additional conductive layer increases the shielding effectiveness of the cable.

Problems occurring terminating multiple shields to ground or in commonly grounding all layers of shielding. Some cables use a metal coated polymer tape wrapped over drain wire which are electrically connected to ground to simplify the termination process. This type of construction can be used where comprises in shielding effectiveness are acceptable. For improved shielding, a metalized tape comprsing of two metal layers sandwiching a non-conductive polymer layer can be used. When two or more layers of such a tape are used in conjunction with one or more drain wires, the effective shielding can be similar to that of a braided wire shield. Multiple layers of such shielding tape however make a cable relatively inflexible. Additionally, the use of multiple metalized tapes will complicate to the termination process when the shield tapes need to be removed.

SUMMARY OF THE INVENTION

The present invention comprises a jacketed cable having at least one metal center conductor for transmitting signals surrounded by electrical insulation. One or more conductive metal drain wires are positioned parallel to an insulated center wire. At least two metal-clad polymer tapes coated on the opposite side from the metal with a thin semiconductive adhesive polymer film are wrapped around the center wire and the drain wires as a unit. Surrounding the tape-wrapped cable is a preferably semiconductive polymer jacket, which may be tape-wrapped or extruded onto the cable. A conductive path is thereby provided between the jacket, the shield, and the drain wires.

It has been found that more than one layer of wrapped metal-coated polymer tape coated on the side opposite the metal coating with a thin adhesive layer of semiconductive polymer film will provide a surprisingly greater shielding of the wrapped cable, particularly when the lay of the tape wrapping is reversed for each layer. Two layers of the above tape will provide equivalent shielding to two layers of polymer film coated with metal on both sides without the extra stiffness caused by the two additional metal layers. Extra metal layers are known to result in extra stiffness in a cable.

This equivalent shielding effect applies to cables whether or not the outer jacket is semiconductive or whether or not a conductived path from the drain wires to the outer jacket is required or desired. If the objective of more than one metal-coated tape wrap layer is only to increase shielding or to provide easier stripping to the cable for termination of the cable, the tape layers may be wound onto the cable in layers with the metal sides of each layer facing an adhesive layer or the adhesive film layers facing each other. Two layers of the tape of the invention are thinner and less stiff then equivalent layers of tape which are metal coated on both sides.

DETAILED DESCRIPTION OF THE INVENTION

With reference now to the drawings, a more detailed description of embodiments of the invention is given. Improved shielding is provided by the present invention by applying a very thin semiconductive adhesive polymer film over the polymer side of a metal-coated polymer tape wrapped around the primary insulation of the cable to serve as the shield to the signal-carrying center conductor.

Figure 1:
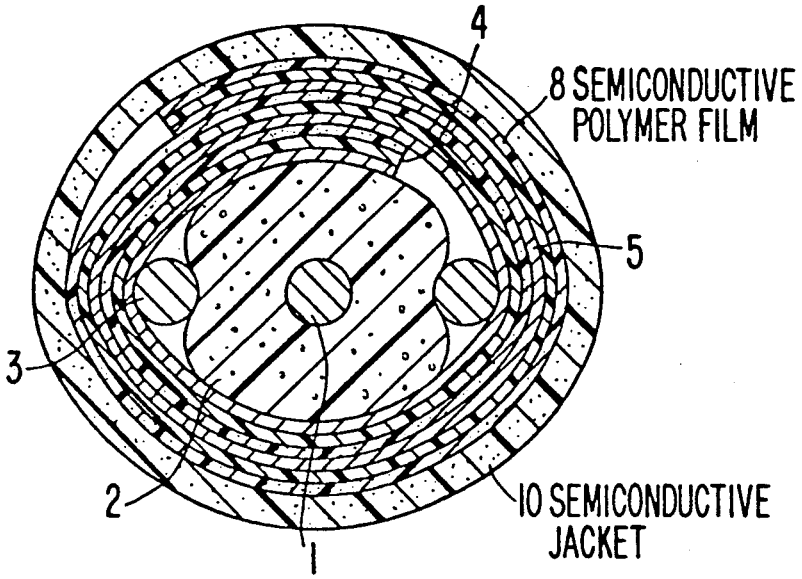
FIG. 1 depicts in cross-sectional view a cable of the invention.

FIG. 1 shows a cross-sectional view of the cable of the invention in which center conductor 1 is surrounded by primary insulation 2, which may be any customary insulation usually known in the art for this use, but preferably for this invention comprises a microporous polymer insulation, and most preferably comprises the microporous expanded polytetrafluoroethylene (PTFE) polymer material disclosed in U.S. Pat. Nos. 3,953,566, 4,187,390, 3,962,153, or 4,096,227, but may be other microporous polymers such as foamed polyolefins or foamed fluorinated ethylene propylene copolymer (FEP) or polyfluoroalkoxy tetrafluoroethylene polymer (PFA). Extending the length of the cable parallel to center conductor 1 are one or two drain wires 3 (two are shown) which comprise the same or similar materials as center conductor 1, such as copper, copper alloys, aluminum or aluminum alloys, noble metal-plated copper and other metal conductors. Insulation 2 may be a tape helically wrapped about center conductor 1 or may be extruded around 1.

An insulated center conductor an drain wires 3 are helically wrapped with two layers of a polymer tape 4 which has on one side a metal coat 5 and on the other side a semiconductive adhesive polymer film layer 8. Polymer tape 4 may be any polymer tape material known to be useful for wrapping around insulated signal conductors of coaxial signal cables. It is usually a thermoplastic polymer, but may be PTFE, and is preferably a polyester tape. Tape 4 may be metal-coated in any customary way with an electrically conductive metal, aluminum being preferred. On the reverse side of tape 4 is affixed a semiconductive polymer film 8, usually a conductive carbon-filled polyester adhesive tape. Other materials could be used to achieve a thinner more flexible coating.

In FIG. 1, semiconductor polymer layer 8 of the tape is in electrical contact with metal layer 5 of the tape where the two layers overlap each other within the wraps of the tape. Metal alyer 5 of the tape is in turn in electrical contact with conductive drain wires 3. Electrical contact is thus established between drain wires 3 and outer semiconductive jacket 10. Jacket 10 comprises a preferably semiconductive polymer material, a conductive carbon-filled fluorocarbon material, such as PFA or FEP, for example. Other thermoplastic fluorocarbon polymers may be used instead of PFA as may other suitable thermoplastic polymers. The use of a conductive film provides the unexpected benefit of a greatly improved electrical contact between the inside of outer jacket 10 and the outside of shield 4. This achieves a measurably more consistent electrical path from outer jacket 10 to inner shield 4 and drain wires 3 owing to the remelting of adhesive during the jacket extrusion process and to the resulting improvement in conformance of the cable to the inside of the jacket.

Another benefit is that semiconductive polymer film 8 could be designed to flow across the polyester film boundary thereby causing continuous, local electrical conductivity between aluminum layers on the inside of the shield wrapped tape layers. This improves cable shielding electrical characteristics. These advantages would apply even if the outer jacket 10 is not conductive.

Another advantage of this invention is that adhesive film 8 melts and flows during the hot extrusion process for jacketing the cable. This serves to seal the shielding system to provide better mechanical integrity and easier strippability for the cable. These advantages would apply even if coating 8 was not conductive.

Applicants jacketed coaxial cable may also comprise a multi-conductor round or flat able wherein several central conductors are surrounded by conductive, semiconductive, and insulative elements as described above. The cable may also comprise a wire harness of a plurality of units of the above cables.

FIG. 1, as stated above, describes a cross-section of a cable having at least two layers of polymer tape 4 wrapped continuously around the drain wires 3 and insulation 2 with the metal coat 5 in contact with drain wires 3.

Figure 2:
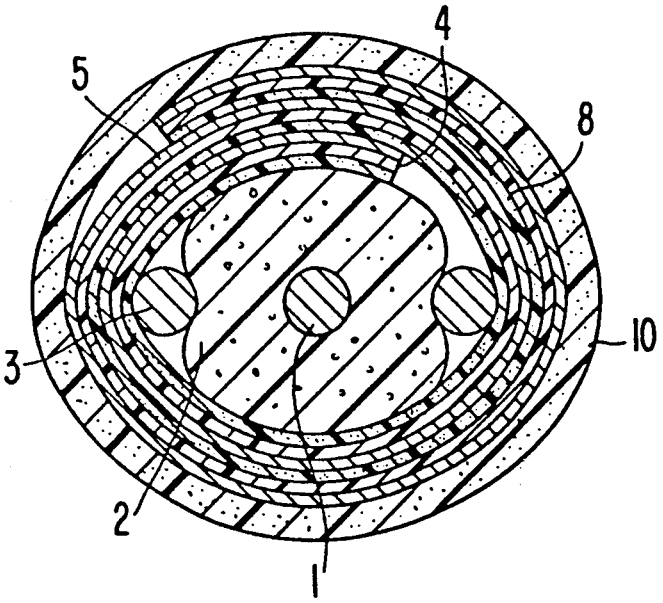
FIG. 2 shows in cross-sectional view a cable having two layers of adhesive and metal-coated film wrapped metal surface-to-metal surface around the insulation and drain wires.

FIG. 2 shows a cable in cross-section wherein the metallized tape is wound continuously as was the tape in FIG. 1, but in FIG. 2 the semiconductive polymer layer 8 on tape 4 is in contact with drain wires 3.

Figure 3:
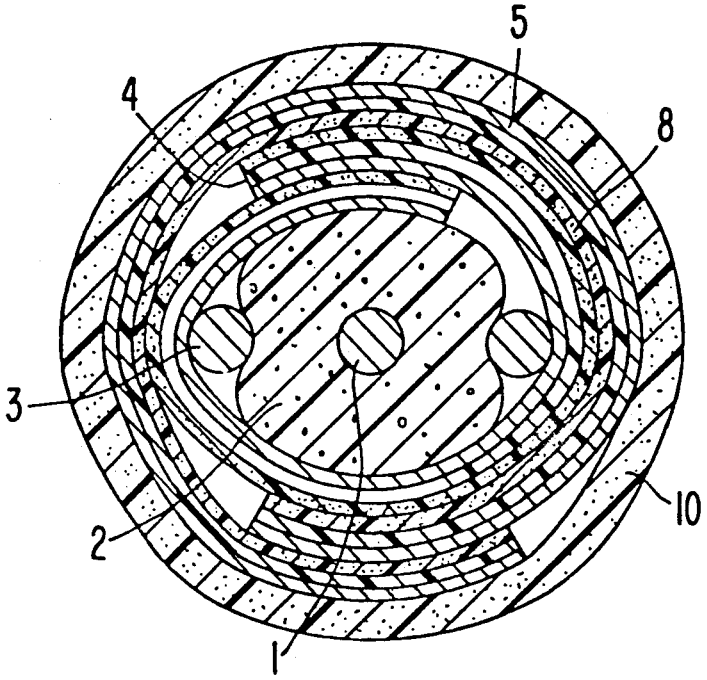
FIG. 3 describes in cross-sectional view a cable having two layers of the adhesive and metal-coated film wrapped adhesive film surface-to-adhesive film surface around the insulation and drain wires.
Figure 4:
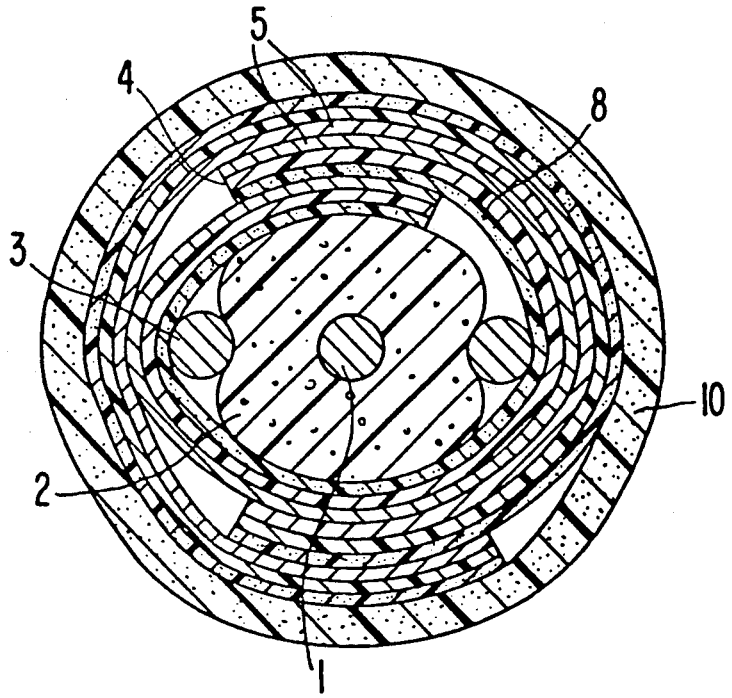
FIG. 4 depicts in cross-sectional view a cable having two layers of film wrapped metal-coated surface to metal-coated surface around the insulation and drain wires.

FIG. 3 depicts in cross-section a cable which has two separate layers of tape 4 wrapped around the drain wires 3 and insulation 2, in this case the metal coating 5 of the first layer of wrapped tape 4 is in contact with drain wires 3, and the second tape layer wrapped so that adhesive layer 8 is adjacent to adhesive layer 8 of the first wrapped tape layer. In FIG. 4, two separate layers of tape 4 are also applied, but have semiconductive polymer layer 8 facing and in contact with drain wires 3, and the second tape layer having metal layer 5 facing metal layer 5 of the second layer of tape. The lay of the second or subsequent layers of tape 4 should be reversed from the lay of the first tape layer in order to maximize the shielding properties of the cables shown in FIGS. 3, 4, 5, or 6.

Figure 5:
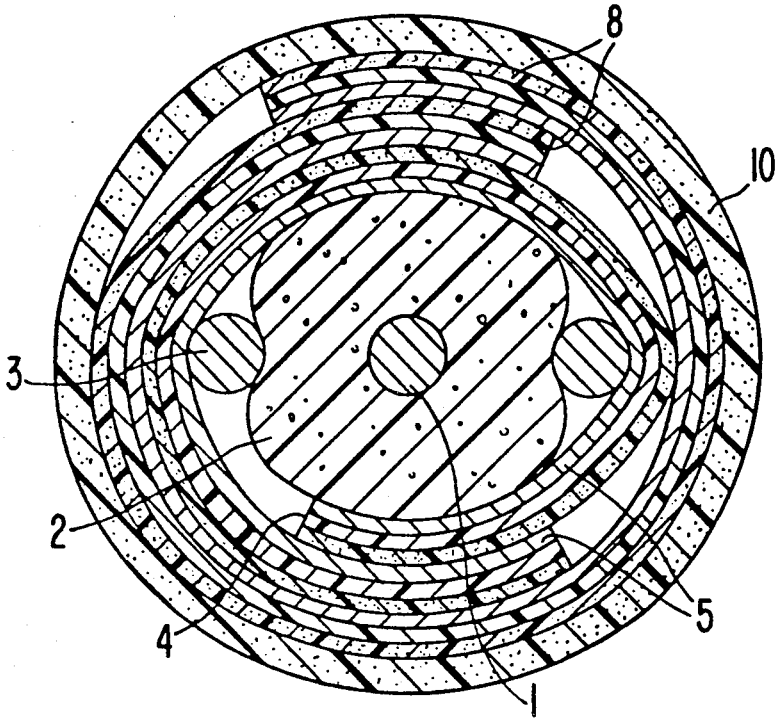
FIG. 5 shows in a cross-sectional view a cable having a layer of film wrapped around the insulation and drain wires, metal-coating toward the drain wires, surrounded by a wrapped layer of metallized polyester tape and a non-conductive jacket.

FIG. 5 shows in cross-section a cable which has two separate layers of tape 4 wrapped around drain wires 3 and insulation 2. In this case the metal coating 5 of the first layer of wrapped tape 4 is in contact with drain wires 3. The second tape layer 4 is wrapped around the first layer of tape 4 with the metal coating 5 adjacent the semiconductive polymer layer 8 on the outside of the first tape layer 4. For maximum shielding effect the lay of the two tape layers is reversed, as above.

Figure 6:
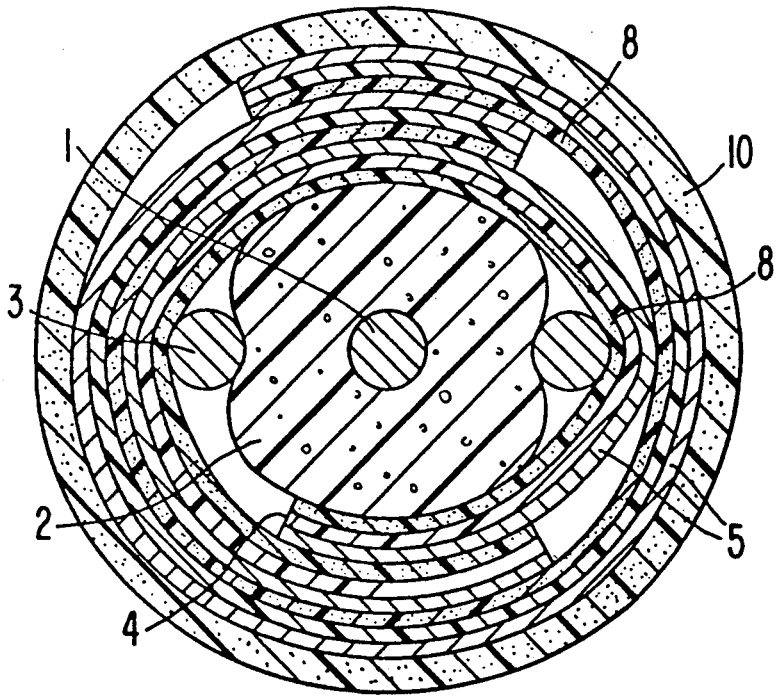
FIG. 6 describes in a cross-sectional view a cable having two separate tape layers with the semiconductive polymer layer of the first tape facing the drain wires and the semiconductive polymer layer of the second tape facing the outside metal layer of the first tape.

FIG. 6 describes in cross-section a cable having as above two separate layers of tape 4, but in this case the semiconductive polymer layer 8 of the first tape 4 faces the metal drain wires 3 and the semiconductive polymer layer 8 of the second tape faces the outside metal layer 5 of the first tape 4. Again, as is preferred, the lay of the two layers of tape is reversed for maximum shielding effect.

Figure 7:
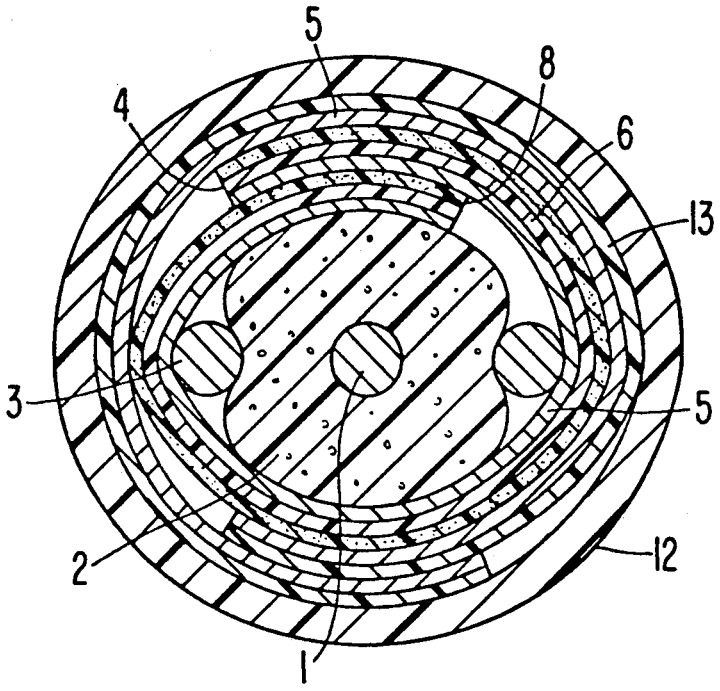
FIG. 7 shows in a cross-sectional view of a cable having a layer of tape having a metal coating on one side which faces the drain wires and a semiconductive polymer coating on the other side which faces the metal side of a polymer tape coated on one side with a metal layer. The cable is jacketed with a non-conductive jacket material.

FIG. 7 describes in cross-section a cable of the invention wherein there is one layer of tape 4, having on one side a metal coating 5 and on the opposite side a layer of semiconductor polymer adhesive film 8, wrapped around drain wires 3 and insulation 2 as a unit. Surrounding this wrapped layer is a wrapped layer of polymer tape 13, such as polyester tape, which has been coated on one side with a metal layer 5. Tape 13 is wrapped metal side in around the tape layer 4. The cab le is now jacketed by means of extrusion or tape wrapping with a non-conductive jacket material 12. In place of polymer tape 13 coated on one side with a metal layer 5 could be alternately utilized a served or braided metal strand shield, braided from metal wires or tapes, for example.

Figure 8:
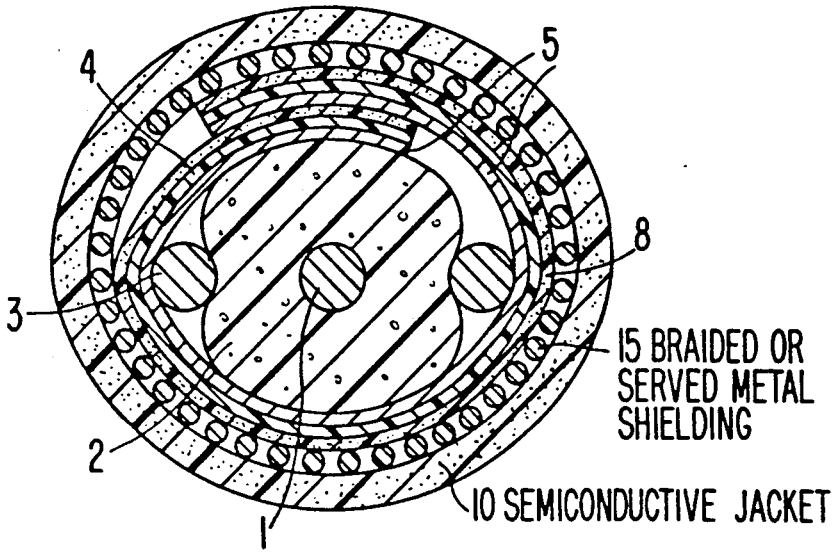
FIG. 8 is a cross-sectional view of a cable having a layer of metal-coated polymer tape coated on the side opposite the metal coating with a thin layer of adhesive semiconductive polymer film, the metal coating of the tape facing and contacting the drain wires, a layer of braided or served metal strands surrounding the tape wrapped cable, and a semiconductive thermoplastic protective jacket surrounding the metal strands.

FIG. 8 describes in a cross-sectional view a cable of the invention wherein a layer of polymer tape 4, coated on one side with a layer of adhesive semiconductive polymer film 8, is wrapped around drain wires 3 and polymer insulation 2. The metal coating 5 faces and is in contact with drain wires 3. Surrounding the tape-wrapped cable is a braided or served metal shielding 15. Surrounding shielding 15 is a protective semiconductive polymer jacket 10.

The advantage of the above cable construction having more than one layer of shielding is that it will provide shielding equal to that of a similar construction having twice as many metal layers without adding the stiffness inherently created by increasing the number of metal shielding layers. The additional advantage of lower attenuation in the preferred forms of the cable occur when some of the semiconductive polymer flows across the polyester boundary to allow local conductivity between metal layers of the metal coated tape layers during heating of the cable during manufacture. This advantage accrues to the cable of FIGS. 1, 3, 5, or 6.

The metal and adhesive coated film of the invention enables a smaller lighter weight cable to be manufactured than if a metal braid is used is the shielding for the cable.

The preferred form of the cab le of the invention, wherein the tape wrapped about the core of the cable has the adhesive layer of the first wrap adjacent the adhesive layer of the second layer of tape, provides a unitized layer which aids in removal o f the shield for termination of the cable. The same advantage is realized where the adhesive layer of the first layer of tape adheres to the metal-coated side of the second layer of tape wrapped around the core of the cable.

We claim:

1. A jacketed coaxial cable comprising from inside to outside:

(a) at least one conductive metal center conductor each surrounded by an (b) electrically insulating material;

(c) one or more electrically conductive drain wires positioned parallel to said center conductor along the length of said cable;

(d) at least two layers of metal-coated polymer type coated on the side opposite the metal coating with a thin adhesive layer of semiconductive polymer film and wrapped around said center conductor, said insulating material, and said drain wires as a unit; and (e) a thermoplastic polymer protective jacket.

2. A cable of claim 1 wherein said thermoplastic polymer protective jacket is semiconductive.

3. A cable of claim 1 wherein each said layers of metal-coated polymer tape are applied with a reverse lay from each said adjacent type.

4. A cable of claim 3 wherein said adhesive layers of two said tapes face each other.

5. A cable of claim 1 wherein said insulating material comprises porous polytetrafluoroethylene.

6. A cable of claim 5 wherein said porous polytetrafluoroethylene comprises expanded polytetrafluoroethylene.

7. A cable of claim 1 wherein said polymer tape comprises thermoplastic polyester and said metal coating thereon comprises aluminum.

8. A cable of claim 1 wherein said jacket comprises a thermoplastic fluoropolymer.

9. A cable of claim 1 wherein said semiconductive polymer film and said semiconductive polymer jacket comprise conductive carbon-filled polymer materials.

10. A cable assembly comprising an multiplicity of coaxial cables surrounded as a unit by a semiconductive thermoplastic polymer protective jacket, each cable therein comprising from inside to outside:

(a) at least one conductive metal center conductor surrounded by an (b) electrically insulating material;

(c) one or more electrically conductive drain wires positioned parallel to said center conductor along the length of said cable;

(d) at least two layers of wrapped metal-coated polymer tape coated on the side opposite the metal coating with a thin adhesive layer of semiconductive polymer film and wrapped around said center conductor, said insulating material, and said drain wires as a unit; and (e) a semiconductive thermoplastic polymer protective jacket.

11. A jacketed coaxial cable comprising from inside to outside:

(a) at least one conductive metal center conductor surrounded by an (b) electrically insulating material;

(c) one or more electrically conductive drain wires positioned parallel to said center conductor along the length of said cable;

(d) a layer of wrapped metal-coated polymer tape coated on the side opposite the metal coating wtih a thin adhesive layer of semiconductor polymer film, said metal coating facing and in contact with said drain wires and wrapped around said center conductor, said insulating material, and said drain wires as a unit;

(e) a layer of metal-coated thermoplastic polyester tape, said metal-coating facing and in contact with the adhesive coated side of said metal coated and adhesive coated tape layer; and (f) a thermoplastic polymer protective jacket.

12. A cable of claim 11 wherein said insulating material comprises expanded polytetrafluoroethylene.

13. A cable of claim 12 wherein said metal coating of said tape comprises aluminum.

14. A jacketed coaxial cable comprising from inside to outside:

(a) at least one conductive metal center conductor surrounded by an (b) electrically insulating material;

(c) one or more electrically conductive drain wires positioned parallel to said center conductor along the length of said cable;

(d) a layer of metal-coated polymer tape coated on the side opposite the metal coating with a thin adhesive layer of semiconductive polymer film, said metal coating facing and in contact with said drain wires and wrapped around said center conductor, said insulating material, and said drain wires as a unit;

(e) a layer of served or braided metal strand shielding; and (f) a thermoplastic polymer protective jacket.

15. A cable of claim 14 wherein said protective jacket is semiconductive.

* * * * *